United States Patent [19]

Raber et al.

[11] Patent Number: 4,803,402

[45] Date of Patent: Feb. 7, 1989

[54] REFLECTION-ENHANCED FLAT PANEL DISPLAY

[75] Inventors: Peter E. Raber, Milford; Robert E. Wisnieff, Weston, both of Conn.

[73] Assignee: United Technologies Corporation, Hartford, Conn.

[21] Appl. No.: 38,440

[22] Filed: Apr. 14, 1987

Related U.S. Application Data

[63] Continuation of Ser. No. 643,206, Aug. 22, 1984, abandoned.

[51] Int. Cl.[4] ..... H01J 17/49; H05B 33/02

[52] U.S. Cl. ..... 313/509; 313/586; 313/587

[58] Field of Search ..... 313/584, 586, 587, 112, 313/113, 514, 517, 509; 315/169.3, 169.4

[56] References Cited

U.S. PATENT DOCUMENTS

| | | | |
|---|---|---|---|
| 2,660,925 | 12/1953 | Turner | 350/1.6 |
| 2,964,666 | 12/1960 | Klasens et al. | 313/113 X |
| 3,579,019 | 5/1969 | Scarbrough | 313/109.5 |
| 3,603,836 | 9/1971 | Grier | 313/201 |
| 3,836,393 | 9/1974 | Ernsthausen et al. | 313/587 X |
| 3,896,323 | 7/1975 | Ernsthausen | 313/587 |
| 3,896,327 | 7/1975 | Schermerhorn | 313/220 |
| 3,935,494 | 1/1976 | Dick et al. | 313/190 |
| 3,973,164 | 8/1976 | Nolan et al. | 313/518 |
| 3,996,489 | 12/1976 | Byrum, Jr. et al. | 313/188 |
| 4,007,396 | 2/1977 | Wisbey et al. | 313/500 |
| 4,152,618 | 5/1979 | Abe et al. | 313/116 |
| 4,229,066 | 10/1980 | Rancourt et al. | 350/1.6 |
| 4,613,793 | 9/1986 | Panicker et al. | 315/169.3 |

OTHER PUBLICATIONS

Michael D. Crisp, David C. Hinson, Robert A. Bennett and Jeffrey I. Seigel, *Luminous Efficiency of a Digivue Display/Memory Panel*, Proceeding of the S.I.D., vol. 16/2, Second Quarter, 1975.

*Primary Examiner*—David K. Moore
*Assistant Examiner*—Sandra L. O'Shea
*Attorney, Agent, or Firm*—Robert P. Sabath

[57] ABSTRACT

A flat display panel arrangement including crossed patterns of parallel electrode wires and a reflective layer for increasing panel luminous intensity.

14 Claims, 2 Drawing Sheets

FIG. 1
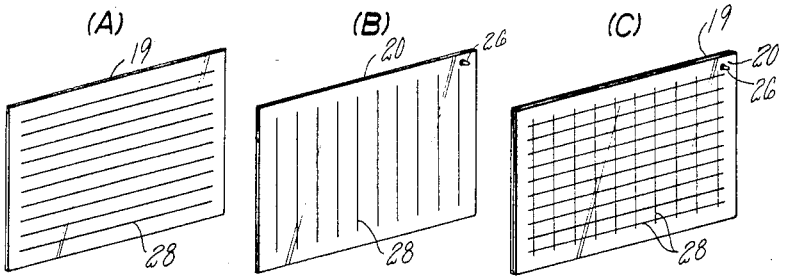
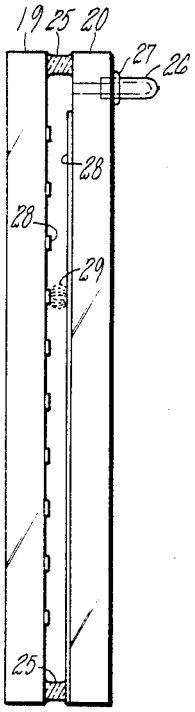
FIG. 2
FIG. 3
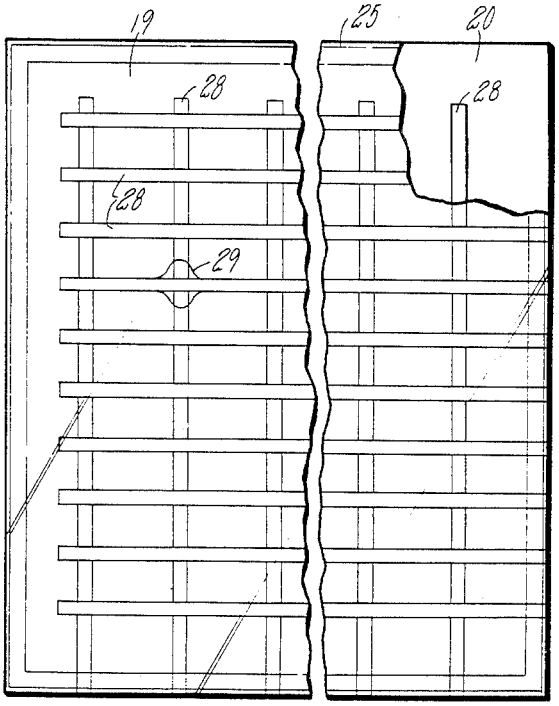

REFLECTION-ENHANCED FLAT PANEL DISPLAY

This application is a continuation of Ser. No. 643,206, filed on Aug. 24, 1984, and now abandoned.

TECHNICAL FIELD

This invention is directed toward the art of flat panel displays including circularly polarizing filters and dielectric mirrors, and more particularly toward such panel displays featuring improved flat panel display visibility.

BACKGROUND ART

AC and DC gas plasma panel displays including a pair of dielectric plates, each having a pattern of parallel electrodes, are well known in the technical art. Electroluminescent displays similarly constructed but with an electroluminescent material in place of the gas plasma, are also well known.

In the conventional AC driven case, a dielectric layer is deposited over the electrodes to store charge and promote the effective operation of the display. The dielectric plates are parallel to one another, and the electrode patterns are orthogonal with respect to one another in the conventional case.

Furthermore, the front dielectric plate is transparent, permitting light to pass to the forward viewer. However, rearwardly directed light from the luminous discharge is largely lost, since it departs through the rear of the display. Additionally, a small portion of the light is reflected from the distant surface of the rear plate, which undesirably offers a secondary image to the viewer, and in effect tends to confuse him with regard to the image he actually desires to view.

Furthermore, the electrodes are typically metallic and opaque in order to provide high conductivity, and are typically highly reflective. The high reflectivity is a fundamental aid to display brightness, and therefore to legibility. In fact, the brightest portion of each perceived "pixel" or picture element (located at the projected intersection of a pair of orthogonal activated electrodes) is the bright reflection of the luminous discharge from the rear electrode. Nevertheless, the width of the electrodes, and therefore of this bright region, is typically smaller than the eye can resolve at normal viewing distances. As a result, the perceived brightness of the pixel is the average of this bright region and the other dimmer region within the resolution dimension of the eye. This is undesirable; the bright region should preferably be even larger than this resolution dimension, for good contrast in high ambient illumination.

The width of the electrodes is not made larger in typical flat panels for several reasons: (1) ordinarily, high resolution is required for these displays; thus electrode spacing needs to be as close as feasible; (2) electrical crosstalk between adjacent electrodes is desirably eliminated by making the nonconductive space between them sufficiently large; (3) some flat panel applications require sufficient transparency to view objects (such as a map) behind the display, and therefore a large transparent region between electrodes is desirable.

One alternative approach is to make the electrodes transparent, rather than opaque. However, this is not compatible with the high conductivity required for such electrodes, and would limit the resulting displays to very small sizes.

Accordingly, it is an object of the invention to improve the brightness and contrast of flat panel displays for use in environments in which the ambient illumination level is relatively high by preventing wasteful disposition of a portion of the light.

DISCLOSURE OF INVENTION

According to one aspect of the instant invention, the dielectric layers and electrodes are preferably thin-film deposited. The dielectric is deposited in multiple thin-film layers of at least two materials whose refractive indices differ in such thicknesses as to insure high reflectivity within the desired light spectrum of the display. Remaining portions of the spectrum may not be of reflective interest, but may desirably be passed through the dielectric. Accordingly, the dielectric layer according to the instant invention may be transparent for part of the spectrum, and reflective for another selected portion thereof.

According to another aspect of the invention, a metallic reflective layer can be employed in lieu of the dielectric reflective layers of the first embodiment of the invention.

BRIEF DESCRIPTION OF DRAWING

The invention herein is best understood by reference to the drawing, which is in several figures, wherein:

FIG. 1 is a schematic illustration of the combination of two electrode panels each including a plurality of spaced parallel wire electrodes;

FIG. 2 is a diagram showing schematically the establishment of a potential difference at the site of apparent crossing of two orthogonal electrode wires somewhat spaced apart, the electrode wires in this case being established in respective parallel electrode panels or plates;

FIG. 3 is a diagram showing schematically the discharge region resulting from plasma or electroluminescent discharge at a selected crossing of wire electrodes subject to a potential difference as suggested in FIG. 2;

BEST MODE FOR CARRYING OUT THE INVENTION

Figure 4:
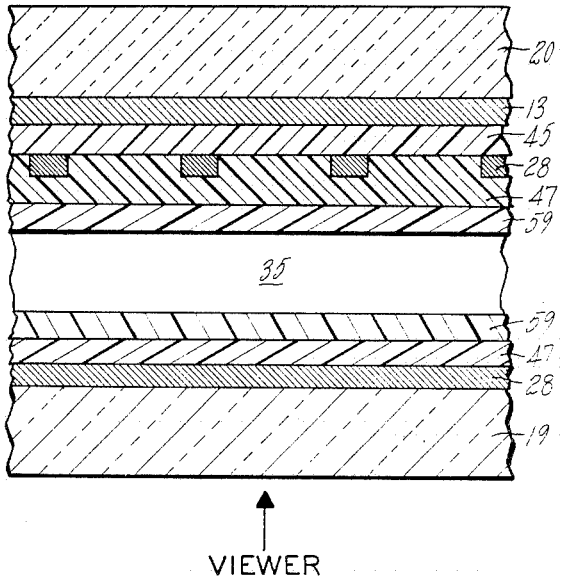
FIG. 4 is a diagram showing schematically a layer arrangement of a metallic reflector version of the invention.

FIG. 1 shows in part A thereof a front plate 19 of the display, which is made for example of a suitable material such as float glass. Glass is particularly effective in this application, because it is a transparent material and relatively resistant to the effects of heat during manufacture and operation. Additionally, glass is typically a substantially durable and scratch resistant material, which makes it a particularly welcome material in the art of constructing displays, and especially suited to thin-film vacuum deposition of the electrodes, dielectric layers, and the electron emitter material.

A plurality of parallel electrode wires 28 are deposited on the plate 19 according to well known techniques. For example, the wires 28 can be established by thick film screening. In the alternative, they can be deposited by photolithographic and thin-film deposition techniques. In this embodiment, the wires 28 in front plate 19 are shown horizontally disposed for the sake of convenient illustration.

The individual electrode wires 28 are electrically addressable by voltage generator (not shown), effective for providing a predetermined voltage level to selected ones of said wires 28. This generator supplies a voltage level above the level of the usual refreshing voltage waveforms which maintain a given display combination.

FIG. 1 additionally shows in part B thereof the rear plate 20 of the display, which is also preferably made of glass. As in the case of front plate 19, rear plate 20 is subject to deposition of a plurality of parallel electrode wires 28, which in this instance are vertically disposed, however. These wires 28 are also electrically addressable in order to determine which of the wires will carry the predetermined voltage level or levels effective for inducing plasma breakdown.

By superimposing the horizontal pattern of the front plate 19 with the vertical pattern of electrode wires in the rear plate 20, a grid of displaced electrode wires is established, as shown in part C of FIG. 1. Moreover, by suitably addressing particular ones of said electrode wires 28, specific ones of the points of apparent intersection can be selected for establishing a voltage difference that will initiate plasma discharge between the plates, respectively 19 and 20.

This is graphically illustrated in the side view of FIG. 2, which shows the electric field lines and illumination pattern 19 from the luminous discharge caused by establishing a suitable voltage difference between selected crossed ones of said electrode wires 28.

Between the plates 19 and 20 is a material such as for example a Penning gas mixture, which includes neon in the case of certain plasma displays, or a phosphor-type material such as for example zinc sulfide activated by manganese or other suitable material in the case of certain electroluminescent displays. This material can be locally excited to emit light by the establishment of an electric field near the projected intersection of electrode wires 28 of the respective plates. Viewing the discharge region frontally as a viewer of the display would, a portion of the discharge light is obstructed because of the interference of the front electrode wire. However, even though the crossed electrode wires 28 were effective for inducing the discharge, the entire discharge does not occur only immediately between the crossed pair.

As seen in FIG. 2, plates 19 and 20 can be sealed with a seal 25 of melted solder or sealng glass to hold or contain the Penning gas in place therebetween. A filler tube 26 is conveniently inserted into a hole 26' in plate 20 to permit the gas to be supplied to the space between plates 19 and 20. The tube 26 is then suitably sealed after filling to prevent loss of the gas after it has been delivered to the display.

Some of the light generated travels to the viewer in front of the display; however, much of the light is lost, as it escapes through the rear panel 20. Some of this light is reflected by the distant surface of the rear panel 20, causing an undesirable secondary image. This latter problem can be solved for applications which do not require viewing of objects behind the display, by making the rear panel 20 relatively opaque. Furthermore, by making the opaque panel 20 dark in color as well, primary image contrast is additionally enhanced.

FIG. 3 shows the plates 19 and 20 again superimposed adjacently with respect to one another in a frontal view. The region of illumination 29, established by luminous discharge at the grid intersection of a pair of orthogonal spaced electrode wires 28, is shown as presented to the viewer.

The region of illumination shown in FIG. 3 originates between the crossed electrode wires 28 and as such is partially obstructed from the viewer by the overlaying effect of the horizontal electrode wires of the front plate 19. This reduces the brightness of the discharge considerably, depending on the specific dimensions of the electrode wire.

On the other hand, whereas the electrode wire of the upper plate 19 tends to diminish the level of illumination, just the opposite effect is achieved by the presence of the electrode wire in the rear plate 20 immediately below, which tends to reflect a portion of the light generated toward the viewer.

Of course, a portion of the light generated above the rear plate 20 is directed toward the viewer ab initio from the moment of generation. Furthermore, it is only that portion of the rearwardly directed light which is generated approximately above the plane of the rear electrode wire and directed toward said rear electrode wire that can be subject to reflection by the rear electrode wire in such manner as to redirect it toward the viewer.

With respect to the ab initio rearwardly directed light not initially directed toward the rear electrode wire initiating the discharge, that light will pass through the rear plate 20 and be lost, because the transparent character of the rear plate will not act to impede the light in any significant manner. It is the recapture of this light which would otherwise be lost that is a goal of the invention herein.

FIG. 4 shows one version of how to carry out the invention addressed herein. In particular, the Figure shows adjacently disposed front and rear plates 19 and 20. A light means region 35 is shown therebetween.

The material in region 35 is preferably a Penning mixture of neon doped with argon or xenon for example in the case of a plasma panel display, or zinc sulfide activated by manganese in the case of an electroluminescent display.

In accordance with the invention, a reflective layer 13 of material is suitably as for example thin-film deposited on the rear plate 20 of the display. In the embodiment of FIG. 4, the reflective layer is metallic in nature and is not necessarily spectrally selective.

In the case of a metallic reflective layer, the electrode wires 28 are separated from the metallic reflector 13 by a suitable dielectric layer 45 which may for example be made of silicon dioxide.

Figure 5:
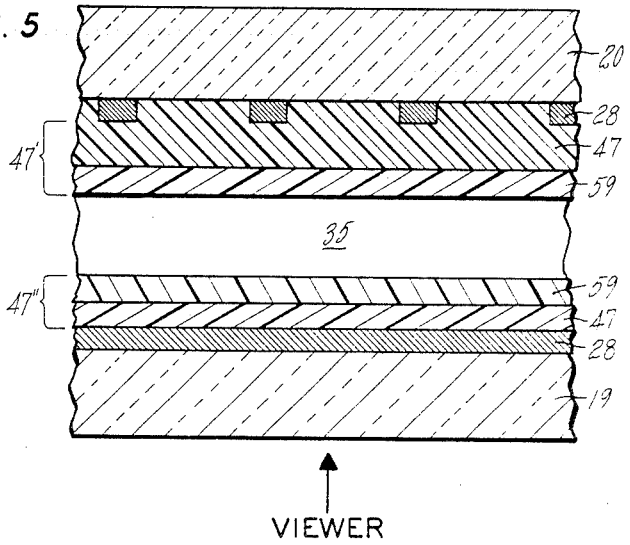
FIG. 5 is a diagram showing schematically a dielectric reflector layered arrangement of the invention, in which the rear dielectric/reflector layer consists of multiple dielectric layers.

In another embodiment of the invention, the reflective layer 13 is dielectric in nature, and is similar to the reflective layer 47 to be discussed in reference to FIG. 5.

In another preferred embodiment of the invention which is shown in FIG. 5, the reflective layer 47' is in front of the rear electrodes 28. The dielectric reflector layer 47' preferably includes for example N pairs of quarter wavelength layers of alternating sublayers having respectively high and low indices of refraction. As seen in FIG. 5, layer 47' includes a final layer 59 of a secondary emitter material as discussed below. Depending upon the number of sublayers, the degree of reflectivity can be determined according to the following formula:

$$R = \frac{n_s - (n_L/n_H)^{2N}}{n_s + (n_L/n_H)^{2N}}^2.$$

where,

R is the reflectivity;

$n_s$ is the index of refraction of the substrate which may for example be float glass;

$n_L$ is the index of refraction of the low index material; and $n_H$ is the index of refraction of the high index material.

According to this relationship, a reflectivity of 0.7104 can be obtained for two sublayer pairs of zinc sulfide, ZnS, and magnesium fluoride, $MgF_2$, on float glass. Six sublayer pairs of the same materials yield a reflectivity of 0.9943. Float glass has an index equal to 1.52; ZnS, 2.3; $MgF_2$, 1.38.

Since the refractive index is dependent upon the wavelength of the light in question, the reflectivity may be maximized for light in one spectral region, for example that of the plasma discharge, while simultaneously being reduced for other spectral regions.

Of course, other methods of designing the reflective layer 13 are possible, and may occur to those skilled in this art. These methods include, but are not limited to the use of more than two different materials, combinations of metallic and dielectric materials, and calculated departures from the stated quarter wavelength thickness condition for dielectric sublayers. All such variations are included in the intention and spirit of this invention.

Electrode wires 28 as already noted above are suitably deposited on the glass 19 and 20 or dielectric 45 surfaces indicated in FIGS. 4 and 5, as the case may be. The preferred method of deposition is developed according to the methods and processes of thin-film deposition technology, such as high temperature vacuum deposition technology. As already discussed, the direction of disposition of the electrode wires in one of plates 19, 20 is orthogonal to the direction of disposition of the electrode wires in the other of said plates 19, 20. This permits addressing particular points of intersection on the grid formed by the overlap of the wire patterns of the two plates.

The electrode wires 28 themselves may be fashioned of gold or aluminum or any other suitable conductor material or combinations of alloys or layers thereof.

At least one layer of suitable dielectric material 47, $SiO_2$ for example, is then as for example by thin-film or vacuum deposition methods applied over the electrode wires 28 to store charge and thereby to allow efficient discharge through the region 35 at activated pixel sites during each of the alternating current half-cycles.

The secondary emitter layer 59 is effective for lowering the minimum electric field intensity desired for discharge in gas plasma panels, thereby promoting efficient operation.

In the case of FIG. 5, a preferred embodiment of the invention is shown, which includes a dielectric reflective layer 47' in lieu of a metallic layer. Layer 47' is used for reflection as well as electrical isolation and charge storage with respect to electrode 18. The reflective layer 47' is comprised of multiple thin-film deposited layers of at least two dielectric materials as for example magnesium oxide and silicon dioxide or other dielectric materials having alternately low and high indices of refraction, such as titanium dioxide and magnesium fluoride, or other materials compatible with thin-film display panels.

The construction of the front plate 19 in FIG. 5 can be the same as in FIG. 4. Simply stated, the electrodes 28 are deposited directly on the front plate 19 which may be of glass. A dielectric layer 47 is then deposited over the electrodes 28, and the secondary electron emitter region 59, if used, is finally deposited over the last dielectric layer 47.

In a preferred embodiment, the dielectric layer on the front plate is a multiple layer 47'' so constructed as to minimize the reflection of the plasma discharge in a matter analogous to that of the rear plate layer 47' which maximizes said reflection.

The rear plate construction of FIG. 5 is analogous to that of FIG. 4, but is somewhat simplified by avoiding the requirement for the separating dielectric 45, which is needed in the case of a metallic reflector 13 to isolate the reflector electrically from the electrode wires 28.

Moreover, the dielectric layer 47' in the case of FIG. 5 serves two independent functions: to store charge as required for efficient panel operation, and to reflect rearwardly directed light back to the viewer in front of the display, thereby enhancing the illumination level and clarity of the display itself. The final layer of the dielectric layer 47', which has been designed for high reflectivity, is the secondary emitter layer 59, when used.

In actual application and use in high ambient illumination environments, it is suggested that the invention be employed with a contrast enhancement filter (not shown) suitably placed between the viewer and the front plate 19 of the display. In particular, a contrast enhancing circular polarizer has an optimal effect in eliminating light components which originate from outside the display. For example, ambient light in the vicinity of the display is circularly polarized in one direction upon entering the displays, and upon specular reflection by the reflective layer reverse polarized in the other direction, whereupon its passage back through the circular polarizer again is effectively blocked. Moreover, since the reflection of ambient light from the reflective coating 13 and 47' is almost perfectly specular, the attenuation of ambient light by the filter is particularly effective.

It is important in the case of the second embodiment that the metallic layer be isolated from the respective electrodes 28, by for example at least a single relatively thick insulating layer which is sufficient electrically to isolate the electrodes from the metallic layer. Separation in the order of 30–100 microns may be sufficient, depending upon the display speed or frequency. This approach is particularly suitable for low AC frequency application, in view of the cross talk between electrodes 28 caused by capacitive coupling at the higher frequency range.

In operation, the forward emitted light passes through a contrast enhancement filter, and the rearwardly emitted light is redirected to the front by specular reflection of the reflective coating provided according to the invention herein. The reflected display light comprises substantially all polarization components, while the reflected ambient light which has passed through the contrast enhancement filter before reflection, consists of substantially circularly polarized light for certain types of contrast enhancement filters.

Notwithstanding the foregoing descriptions and illustrations, which have been more particularly directed toward gas plasma panels, the invention herein is also applicable to constructions in which all or most of the layered arrangements, including the luminous material or light means in region 35 and both sets of electrodes 28 for example, are deposited on only one of the plates 19 or 20. Such constructions are appropriate for elecroluminescent flat panel displays, which do not require a gap between the plates for backfilling with gas. In such cases, the fill tube shown in FIG. 2 would be unnecessary, and the seal would not be located between the respective planes of the crossed electrodes.

The description above explains the invention in terms of several preferred modes for usefully implementing the constructions shown. Nonetheless, it is cautioned that the actual scope of the invention is broader than the mere breadth of the embodiments expressly indicated. It is thus urged that reference be made to the claims below, which explicitly set forth the metes and bounds of the invention.

We claim:

1. A flat display panel for displaying a predetermined pattern of light in response to an alternating applied electric field comprising:

light means for producing light in response to the application of said alternating applied electric field;

a first plurality of parallel electrodes for establishing selected electric fields, said first plurality of electrodes being disposed on a rear side of said light means;

a second plurality of parallel electrodes for cooperating with said first plurality in the establishment of said selected electric fields, said second electrode plurality being disposed on a front side of said light means and being parallel to the plane of said first electrode plurality, said electrodes of said second plurality being generally orthogonal to said first plurality of parallel electrodes;

front and rear dielectric charge storage layers, disposed respectively between said first and second pluralities of parallel electrodes and said light means, whereby said applied electric field passes through said front and rear dielectric charge storage layers, said front charge storage layer being substantially transparent, characterized in that:

said rear dielectric charge storage layer includes at least one pair of rear dielectric sublayers of different index of refraction extending over said first plurality of parallel electrodes, each sublayer having an optical thickness of one-quarter wavelength of a predetermined optical wavelength in said visible spectrum, said optical thicknesses and indices of refraction being such that said pair of rear dielectric sublayers cooperate to provide increased reflectivity in said visible spectrum, whereby said at least one pair of rear dielectric sublayers is subjected to said applied alternating electric field and said near dielectric charge storage layer performs both the functions of isolating said first plurality of electrodes from one another and storing charge and of reflecting light from said light means through said front dielectric charge storage layer.

2. A flat display panel according to claim 1, further characterized in that said front dielectric charge storage layer also includes at least one pair of front dielectric sublayers of different index of refraction extending over said second plurality of parallel electrodes, each sublayer having an optical thickness of one-quarter wavelength of a predetermined optical wavelength in said visible spectrum, said optical thicknesses and indices of refraction being such that said pair of front dielectric sublayers cooperate to provide an antireflection coating having decreased reflectivity in said visible spectrum.

3. A flat display panel according to claim 1, further characterized in that said light means is a gas mixture for producing light from a plasma in response to said alternating applied electric field and further comprising transparent support means for confining said gas mixture and supporting said electrodes and charge storage layers.

4. A flat display panel according to claim 2, further characterized in that said light means is a gas mixture for producing light from a plasma in response to said alternating applied electric field and further comprising transparent support means for confining said gas mixture and supporting said electrodes and charge storage layers.

5. A flat display panel according to claim 1, further characterized in that said light means is an electroluminescent layer.

6. A flat display panel according to claim 2, further characterized in that said light means is an electroluminescent layer.

7. A gas plasma display panel for displaying a predetermined pattern of light in response to an alternating applied electric field comprising:

front and rear plate means for establishing a display surface, said front means being substantially transparent;

gas means of predetermined composition for producing light in a display region of the visible spectrum from a plasma, in response to the application of said electric field, said plate means being effective for containing said gas means in a bounded volume between inner surfaces of said front and rear plate means;

a first plurality of parallel electrodes for establishing selected electric fields, said first plurality of electrodes being disposed between said front plate means and said gas means;

a second plurality of parallel electrodes for cooperating with said first plurality in the establishment of said selected electric fields, said second electrode plurality being disposed between said rear plate means and said gas means and being parallel to the plane of said first electrode plurality, said electrodes of said second plurality being generally orthogonal to said first plurality of parallel electrodes;

front and rear dielectric charge storage layers, disposed respectively between said first and second pluralities of parallel electrodes and said gas means, whereby said applied electric field passes through said front and rear dielectric charge storage layers, said front charge storage layer being substantially transparent; and at least one secondary emission layer electrochemically compatible with said gas means for emitting electrons, characterized in that:

said front dielectric charge storage layer is substantially transparent in a predetermined window region of the visible spectrum, said window region including at least said display region;

said front plate means is substantially transparent in said predetermined window region;

said rear dielectric charge storage layer includes at least one pair of inorganic rear dielectric sublayers of different index of refraction, each sublayer having an optical thickness of one-quarter wavelength of a predetermined optical wavelength in the visible spectrum, so that said at least one pair of rear dielectric sublayers cooperate to provide increased reflectivity in said display region of the visible spectrum and light produced within said bounded volume by said gas means and having a wavelength within said display region of the visible speotrum is reflected from said rear dielectric charge storage layer through said front dielectric charge storage layer and said front plate means to increase the amount of light passing therethrough, whereby said rear dielectric charge storage layer performs both the functions of reflecting display radiation and charge storage.

8. A gas plasma display panel according to claim 7, further characterized in that said secondary emission layer is one of said at least one pair of dielectric sublayers so that said secondary emission layer performs both the functions of electron emission and reflection enhancement.

9. A gas plasma display panel according to claim 7, further characterized in that said rear plate means and said rear dielectric charge storage layer, including said at least one pair of inorganic rear dielectric sublayers, are substantially transparent in a background region of the visible spectrum included in said window region, whereby an optical viewing path exists in said background region through said front and rear dielectric charge storage layers and said front and rear plate means and said rear dielectric charge storage layer performs the additional function of passing light in said background region through said display, as well as reflecting light in said display region.

10. A gas plasma display panel according to claim 7, further characterized in that said front dielectric charge storage layer includes at least one pair of front dielectric sublayers of different index of refraction, each sublayer having an optical thickness of one-quarter wavelength of a predetermined optical wavelength in the visible spectrum, whereby said at least one pair of front dielectric sublayers cooperate to provide decreased reflectivity in said display region of the visible spectrum, whereby transmission of light produced within said bounded volume by said gas means and having a wavelength within said display region of the visible spectrum is enhanced.

11. A gas plasma display panel according to claim 8, further characterized in that said rear plate means and said rear dielectric charge storage layer, including said at least one pair of inorganic rear dielectric sublayers, are substantially transparent in a background region of the visible spectrum included in said window region, whereby an optical viewing path exists in said background region through said front and rear dielectric charge storage layers and said front and rear plate means and said rear dielectric charge storage layer performs the additional function of passing light in said background region through said display panel, as well as reflectling light in said display region storing charge and emitting electrons.

12. A gas plasma display panel according to claim 8, further characterized in that said front dielectric charge storage layer includes at least one pair of front dielectric sublayers of different index of refraction, each sublayer having an optical thickness of one-quarter wavelength of a predetermined optical wavelength in the visible spectrum, whereby said at least one pair of front dielectric sublayers cooperate to provide decreased reflectivity in said display region of the visible spectrum, whereby transmission of light produced within said bounded volume by said gas means and having a wavelength within said display region of the visible spectrum is enhanced.

13. A gas plasma display panel according to claim 9, further characterized in that said front dielectric charge storage layer includes at least one pair of front dielectric sublayers of different index of refraction, each sublayer having an optical thickness of one-quarter wavelength of a predetermined optical wavelength in the visible spectrum, whereby said at least one pair of front dielectric sublayers cooperate to provide decreased reflectivity in said display region of the visible spectrum and are substantially transparent in said background region of the visible spectrum, whereby transmission of light produced within said bounded volume by said gas means and having a wavelength within said display region of the visible spectrum is enhanced.

14. A gas plasma display panel according to claim 9, further characterized in that said secondary emission layer is one of said at least one pair of dielectric sublayers so that said secondary emission layer performs both the functions of electron emission and reflection enhancement.

* * * * *

UNITED STATES PATENT AND TRADEMARK OFFICE

CERTIFICATE OF CORRECTION

PATENT NO. : 4,803,402

DATED : February 7, 1989

INVENTOR(S) : Peter E. Raber et al

It is certified that error appears in the above-identified patent and that said Letters Patent is hereby corrected as shown below:

Column 7, line 59, "near" should read --rear--.

Column 9, line 37, after "said display" insert --panel--.

Column 10, line 15, "reflectling" should read --reflecting--.

Signed and Sealed this

Twenty-seventh Day of March, 1990

*Attest:*

JEFFREY M. SAMUELS

*Attesting Officer*

*Acting Commissioner of Patents and Trademarks*